US009848472B1

(12) United States Patent
Chang et al.

(10) Patent No.: US 9,848,472 B1
(45) Date of Patent: Dec. 19, 2017

(54) LED DEVICE WITH ENERGY COMPENSATION

(71) Applicant: Alfasemi Inc., Taipei (TW)

(72) Inventors: Yu-Cheng Chang, Cupertino, CA (US); Chang-Hung Hsieh, Hsinchu (TW)

(73) Assignee: ALFASEMI INC., Taipei (TW)

( * ) Notice: Subject to any disclaimer, the term of this patent is extended or adjusted under 35 U.S.C. 154(b) by 0 days.

(21) Appl. No.: 15/447,163

(22) Filed: Mar. 2, 2017

(51) Int. Cl.
*H05B 33/08* (2006.01)

(52) U.S. Cl.
CPC ..... *H05B 33/083* (2013.01); *H05B 33/0812* (2013.01); *H05B 33/0851* (2013.01)

(58) Field of Classification Search
None
See application file for complete search history.

(56) References Cited

U.S. PATENT DOCUMENTS 9,301,353 B2 * 3/2016 Park ..... H05B 33/0815
2013/0155561 A1 * 6/2013 Lai ..... H02H 3/202 361/91.5

* cited by examiner

*Primary Examiner* — Dedei K Hammond
(74) *Attorney, Agent, or Firm* — Bacon & Thomas, PLLC

(57) ABSTRACT

An LED device with energy compensation includes a first LED driving circuit, a second LED driving circuit, and a capacitor. The first LED driving circuit includes a first LED driver and a plurality of first LED groups controlled by the first LED driver. The second LED driving circuit including a second LED driver and a plurality of second LED groups controlled by the second LED driver. The second LED driving circuit is connected in parallel with the first LED driving circuit. The capacitor has a first terminal coupled to the second LED driving circuit and a second terminal coupled to one of the first LED driving circuit and the second LED driver. A power source is coupled to the first LED driving circuit, the second LED driving circuit, and the first terminal of the capacitor for applying an AC power to the first terminal of the capacitor.

10 Claims, 8 Drawing Sheets

LED DEVICE WITH ENERGY COMPENSATION

BACKGROUND OF THE INVENTION

1. Field of the Invention

The present invention relates to an LED device and, more particularly, to an LED device with energy compensation.

2. Description of Related Art

Typically, an LED device is provided with a plurality of LEDs that are driven by an LED driver for illumination. The linear LED driver is known as one of the most popular LED drivers for sequentially driving the LEDs. With the linear LED driver, the waveform of the total consumed energy (or total consumed current) of the LED device is close to a sinusoid, so as to match the shape and phase of an AC power (voltage) provided from a power source, thereby achieving a high power factor (PF) value. FIG. 1(A) is a schematic diagram illustrating the structure of a prior linear LED device 100. As shown in FIG. 1(A), the prior linear LED device 100 includes a plurality of LEDs 101 to 104 and a linear LED driver 105. FIG. 1(B) is a schematic diagram illustrating the waveform of the total consumed energy, as denoted by energy_total, of the prior linear LED device 100 in operation. As shown in FIG. 1(B), the LED driver 105 sequentially turns on or off the LEDs 101 to 104, and the waveform of the total consumed current of the prior linear LED device 100 is close to a sinusoid.

However, such a prior linear LED device 100 is likely to generate a flicking phenomenon, which indicates that the difference between the peak and valley of the consumed powers is huge, resulting in the flicking phenomenon when the prior linear LED device 100 is in operation.

In general, the flicking index indicates the flicking phenomenon. When the flicking index is high, the flicking phenomenon is significant. The flicking index can be presented as the following formula:

flicking index=area1/(area1+area2);

wherein, area1 means an area surrounded by the consumed power value higher than an average value, and area1 means an area surrounded by the consumed power lower than the average value.

Although there are several schemes proposed to solve the flicking problem, for example, controlling the waveform of the total consumed energy of the LED device to be close to a constant waveform or a DC-like waveform, these schemes are not satisfactory and may cause a low PF value due to the waveform of the consumed current provided from the power source not being a sinusoid-like waveform.

Therefore, there is a need to provide an improved LED device for achieving a high PF value and decreasing the flicking.

SUMMARY OF THE INVENTION

An object of the present invention is to provide an LED device with energy compensation, which comprises: a first LED driving circuit including a first LED driver and a plurality of first LED groups controlled by the first LED driver, wherein each of the first LED groups includes at least one LED; a second LED driving circuit including a second LED driver and a plurality of second LED groups controlled by the second LED driver, wherein the second LED driving circuit is connected in parallel with the first LED driving circuit, and each of the second LED groups includes at least one LED; and a capacitor having a first terminal coupled to the second LED driving circuit, wherein a power source is coupled to the first LED driving circuit, the second LED driving circuit, and the first terminal of the capacitor for applying an AC power to the first terminal of the capacitor. Thus, the capacitor and the second LED driving circuit can influence the waveform of the total consumed current of the LED device so as to minimize the difference between the peak and valley of the consumed power, and enable the phase of the waveform of the total consumed current to be consistent with that of the AC power provided from the power source.

In an embodiment, when PF value is equal or close to 1, the AC power is an voltage with a waveform including an increasing period corresponding to the phase of 0 to 90 degrees, and a decreasing period corresponding to the phase of 90 to 180 degrees.

Preferably, in the increasing period, the capacitor receives the energy from the power source, so that the current flowing through the first LED groups is influenced.

Preferably, in the decreasing period, the second. LED driver draws energy form the capacitor so as to provide a compensation current, and a part of the total consumed current of the LED device is increased due to an influence from the compensation current.

In an embodiment, the power source is coupled to a first terminal of the capacitor via a front LED, and a waveform of the capacitor current is influenced by the front LED.

In an embodiment, the compensation current has a phase inconsistent with that of the AC power source.

In an embodiment, a waveform of the total consumed current has a phase consistent with that of the AC power source.

In an embodiment, a number of the first LED groups is m, and a number of the second LED groups is n, wherein m and n are positive integer greater than one, and the 1st to m-th first LED groups correspond to 1st to m-th first driving energy thresholds, and the 1st to n-th second LED groups correspond to 1st to n-th second driving energy thresholds, and the 1st to m-thirst driving energy thresholds are monotonic, the 1st to n-th second driving energy thresholds are monotonic.

Preferably, the n-th second driving energy threshold is lower than the m-th first driving energy threshold.

In an embodiment, the first LED driver includes a plurality of amplifiers with a number corresponding to that of the first LED groups, and the second LED driver includes a plurality of amplifiers with a number corresponding to that of the second LED groups.

DETAILED DESCRIPTION OF THE PREFERRED EMBODIMENT

It is noted that, the term "coupled" hereinafter used in the invention may be representative of "directly connected" or "indirectly connected".

Figure 1A:
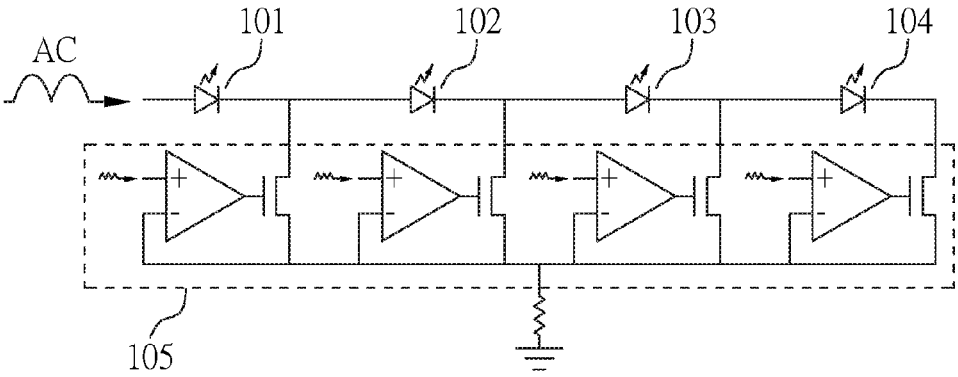
FIG. 1(A) (PRIOR ART)
FIG. 1(A) is a schematic diagram illustrating the structure of a prior LED device.
Figure 1B:
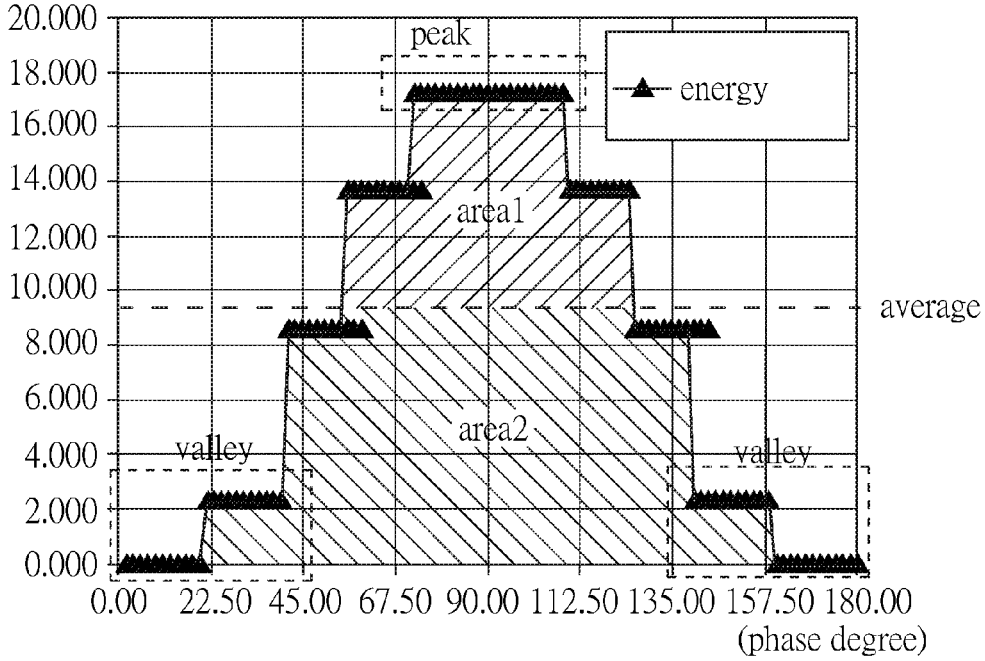
FIG. 1(B) (PRIOR ART)
FIG. 1(B) is a schematic diagram illustrating the total consumed energy of the prior LED device in operation.
Figure 2A:
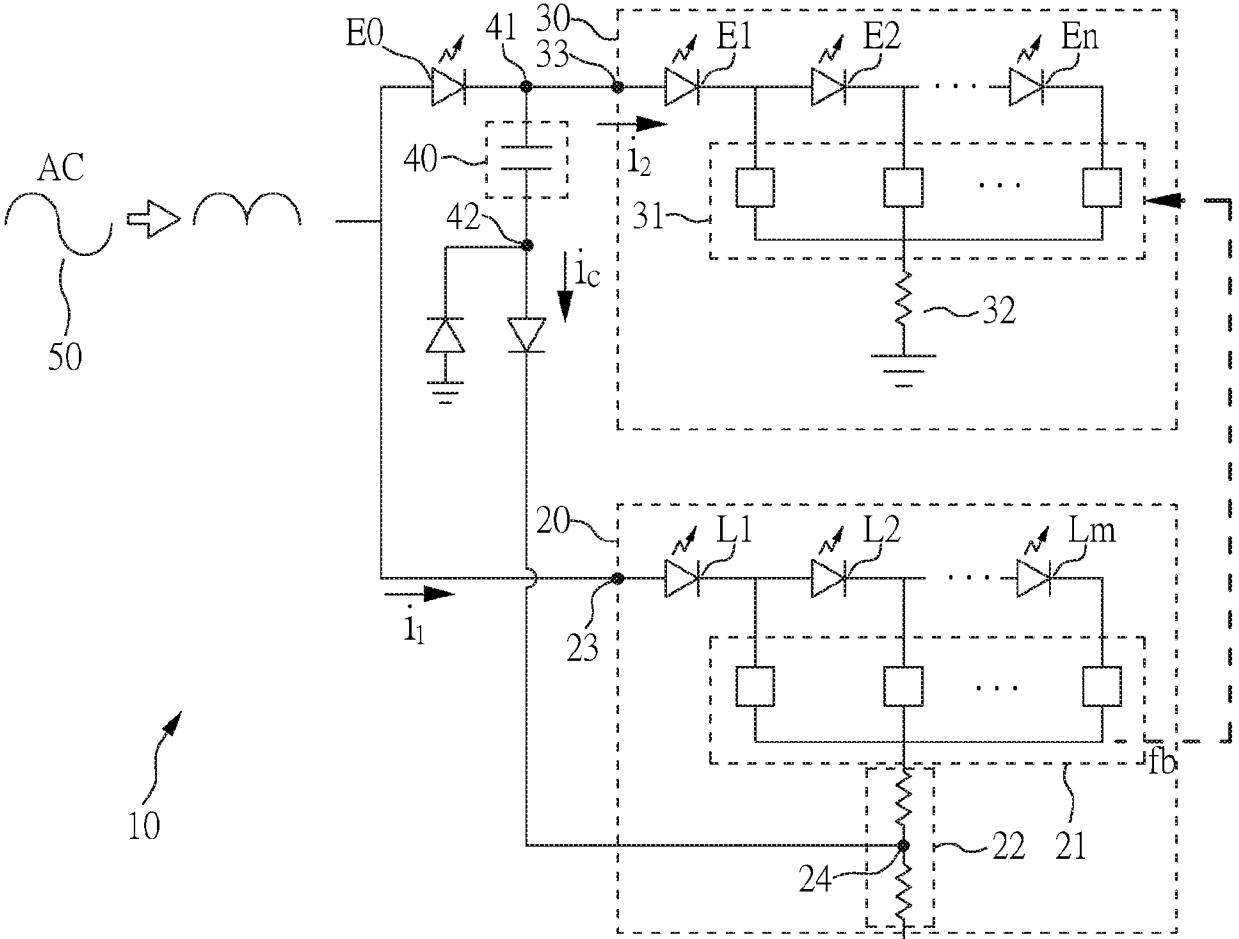
FIG. 2(A) is a circuit diagram illustrating an LED device with energy compensation according to an embodiment of the invention.

FIG. 2(A) is a circuit diagram illustrating an LED device with energy compensation 10 according to an embodiment of the invention. The LED device with energy compensation 10 includes a first LED driving circuit 20, a second LED driving circuit 30, and a capacitor 40.

The first LED driving circuit 20 includes a first LED driver 21 and a plurality of first LED groups L1 to Lm, where m is a positive integer greater than one, and the first LED groups L1 to Lm are driven by the first LED driver 21 for being turned on, and each of the first LED groups L1 to Lm includes at least one LED. The second LED driving circuit 30 includes a second LED driver 31 and a plurality of second LED groups E1 to En, where n is a positive integer greater than one, and the second LED groups E1 to En are driven by the second LED driver 31 for being turned on, and each of the second LED groups E1 to En includes at least one LED. The number of the first LED groups L1 to Lm can be different from that of the second LED groups E1 to En. Besides, the first LED driving circuit 20 is preferably connected in parallel with the second LED driving circuit 30. The capacitor 40 has a first terminal 41 and a second terminal 42. The first terminal 41 of the capacitor 40 is coupled to a first terminal 33 of the second LED driving circuit 30, and the second terminal 42 of the capacitor 40 is coupled to a first terminal 23 of the first LED driving circuit 20 according to this embodiment. However, in other embodiments, the second terminal 42 of the capacitor 40 is coupled to a second terminal 34 of the second LED driving circuit 30 or is coupled to ground.

The first terminal 41 of the capacitor 40 is coupled to a power source 50 for receiving energy. For example, the power source 50 applies an AC power to the first terminal 41, so that the capacitor 40 can store the energy, such as an AC current, from the power source 50. In an embodiment, the first terminal 41 of the capacitor 40 is coupled to the power source 50 via a front LED group E0 including at least one LED, and the front LED group E0 can influence the waveform of a capacitor current (ic) flowing through the capacitor 40. Besides, the power source 50 is also coupled to a first terminal 23 of the first LED driving circuit 20, so that the first LED driving circuit 20 receives energy from the power source 50, and the first LED driver 21 enables a driving current (i1) to flow through the first LED groups L1 to Lm for driving the first LED groups L1 to Lm. In other words, when the LED device 10 is in operation, the energy consumed by the capacitor 40 and the first LED driving circuit 20 is provided from the power source 50. It is noted that, in an embodiment, although the power source 50 is also coupled to the first terminal 33 of the second LED driving circuit 30 via the front LED group E0 and the first terminal 41 of the capacitor 40, the energy consumed by the second LED driving circuit 30 in operation is provided from the capacitor 40. It is noted that if the value of the capacitor current (ic) is increased, the value of the driving current (i1) may be drop.

Figure 2B:
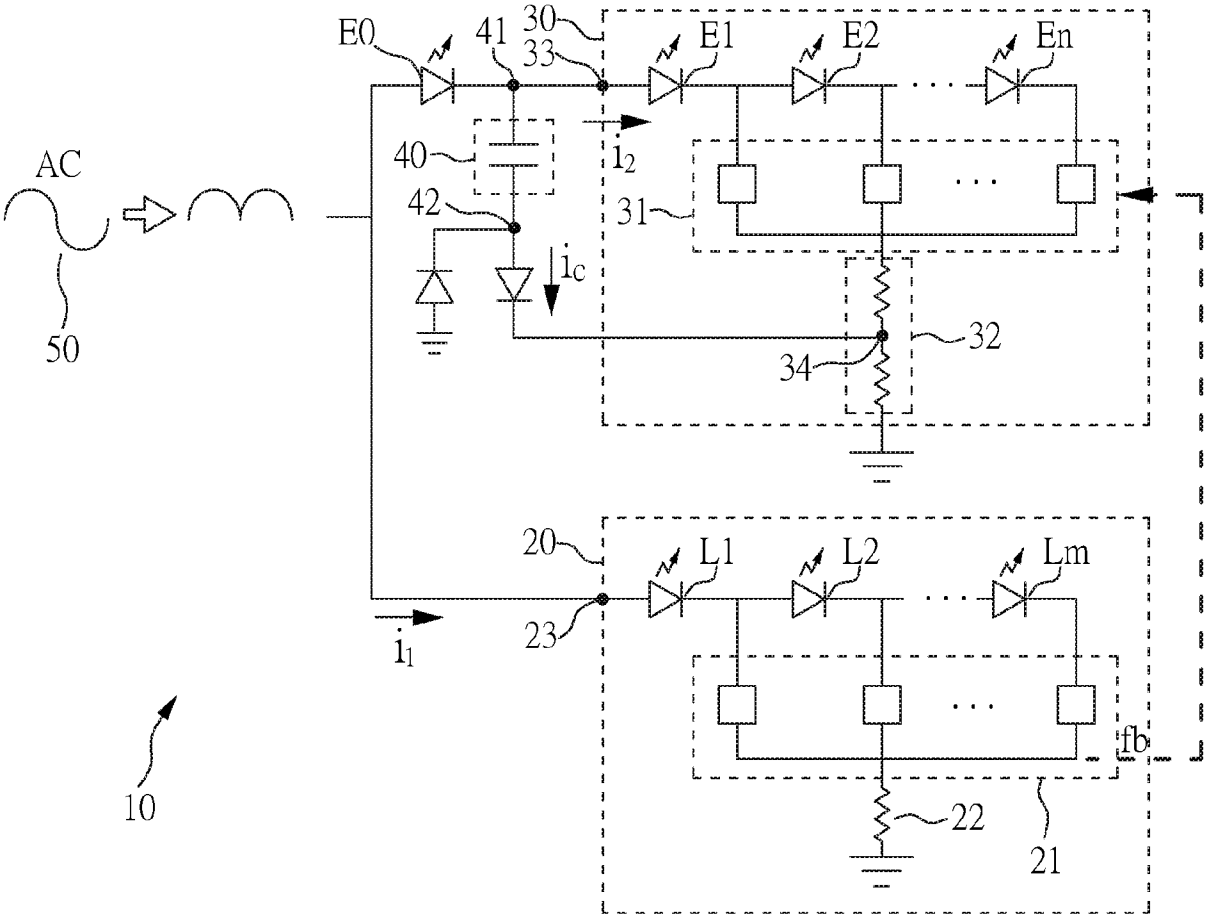
FIG. 2(B) is another circuit diagram illustrating an LED device with energy compensation according to an embodiment of the invention.

In this embodiment, the first LED driving circuit 20 further includes a sensing resistor group 22 having a terminal connected to ground and a node 24 coupled to the second terminal 42 of the capacitor 40. Alternatively, as shown in FIG. 2(B), the second LED driving circuit 30 further includes a sensing resistor group 32 having a terminal connected to ground and a node 34 coupled to the second terminal 42 of the capacitor 40. Besides, as shown in FIG. 2(A) or FIG. 2(B), the sensing resistor group 22 or 32 preferably includes, but not limited to, two resistors connected in series, and the second terminal 42 of the capacitor 40 is coupled to the node between the two resistors of the resistor group 22 or 32.

Figure 2C:
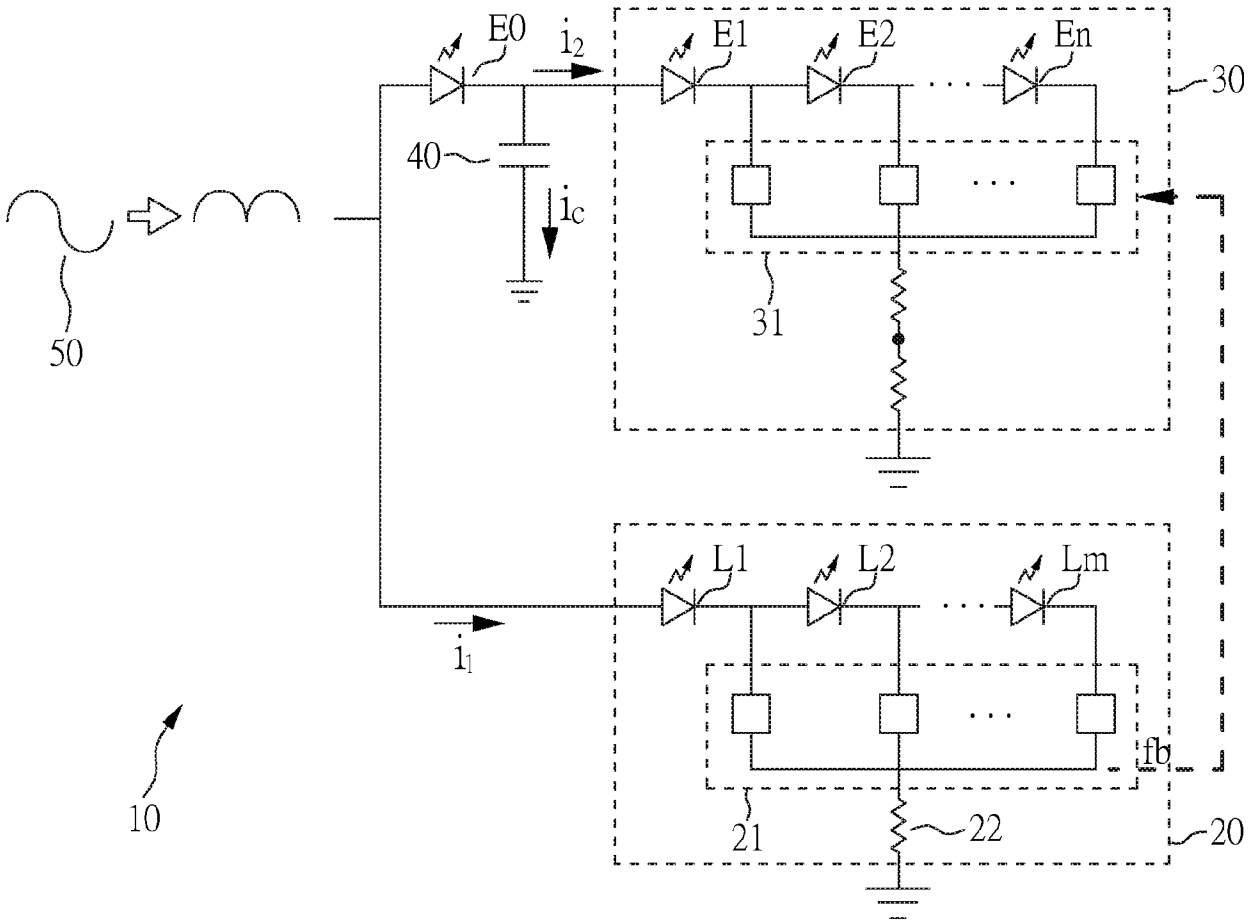
FIG. 2(C) is still another circuit diagram illustrating an LED device with energy compensation according to an embodiment of the invention.

FIG. 2(C) is still another circuit diagram illustrating the LED device with energy compensation 10 according to an embodiment of the invention. Comparing FIG. 2(C) with FIG. 2(A) or 2(B), the first terminal of the capacitor 40 is still coupled to the power source 50 via the front LED E0 in FIG. 2(C), but the second terminal of the capacitor 40 is coupled to ground.

With reference to FIG. 2(A) to 2(C), the first LED driving circuit 20 sends its feedback value (fb) to the second LED driving circuit 30, the second driver 31 can be enabled or disabled according to the feedback value (fb). It is said that, when the driving circuit (i1) receiving energy from the power source 50 is decreased, the second driver 31 can be enabled and the compensation circuit (i2) can be provided, so that the difference between the peak and valley of the consumed power can be reduced.

Besides, in an embodiment, each of the first LED groups L1 to Lm includes a plurality of LEDs connected in series with each other, connected in parallel with each other, or connected in a combination of serial connection and parallel connection. Similarly, in an embodiment, each of the second LED groups E1 to En includes a plurality of LEDs connected in series with each other, connected in parallel with each other, or connected in a combination of serial connection and parallel connection.

About the first LED groups L1 to Lm, the first LED groups L1 to Lm is preferably but not limited to be connected in series with each other. Similarly, the second LED groups E1 to En of the second LED driving circuit 30 is preferably but not limited to be connected in series with each other, i.e., the 1st first LED group L1 is preferably connected in series with the 2nd first LED group L2.

In an embodiment, the first LED driver 21 is preferably but not limited to be a linear LED driver including a plurality of amplifiers with a number corresponding to the number of the first LED groups L1 to Lm. The second LED driver 31 is preferably but not limited to be a linear LED driver including a plurality of amplifiers with a number corresponding to the number of the second LED groups E1 to En. In other embodiments, the first LED driver 21 and the second LED driver 31 are not the linear LED driver, so that the time-variable reference voltages, such as sine waves, can be applied to the first LED driver 21 or the second LED driver 31.

In addition, the AC power (voltage) provided from the power source 50 has a waveform including an increasing period corresponding to the phase of 0 to 90 degrees of the AC power, and a decreasing period corresponding to the phase of 90 to 180 degrees of the AC power. To achieve a high PF value, the waveform of the total consumed current should be close to that of the AC power. In an embodiment, in the increasing period, the capacitor current (ic) flowing through the capacitor 40 influences part of the total consumed current of the LED device 10. In an embodiment, in the decreasing period, the second LED driver 31 receives energy from the capacitor 40 to provide a compensation current (i2) flowing through the second LED groups E1 to En, and the compensation current (i2) influences part of the total consumed current of the LED device 10.

Figure 3:
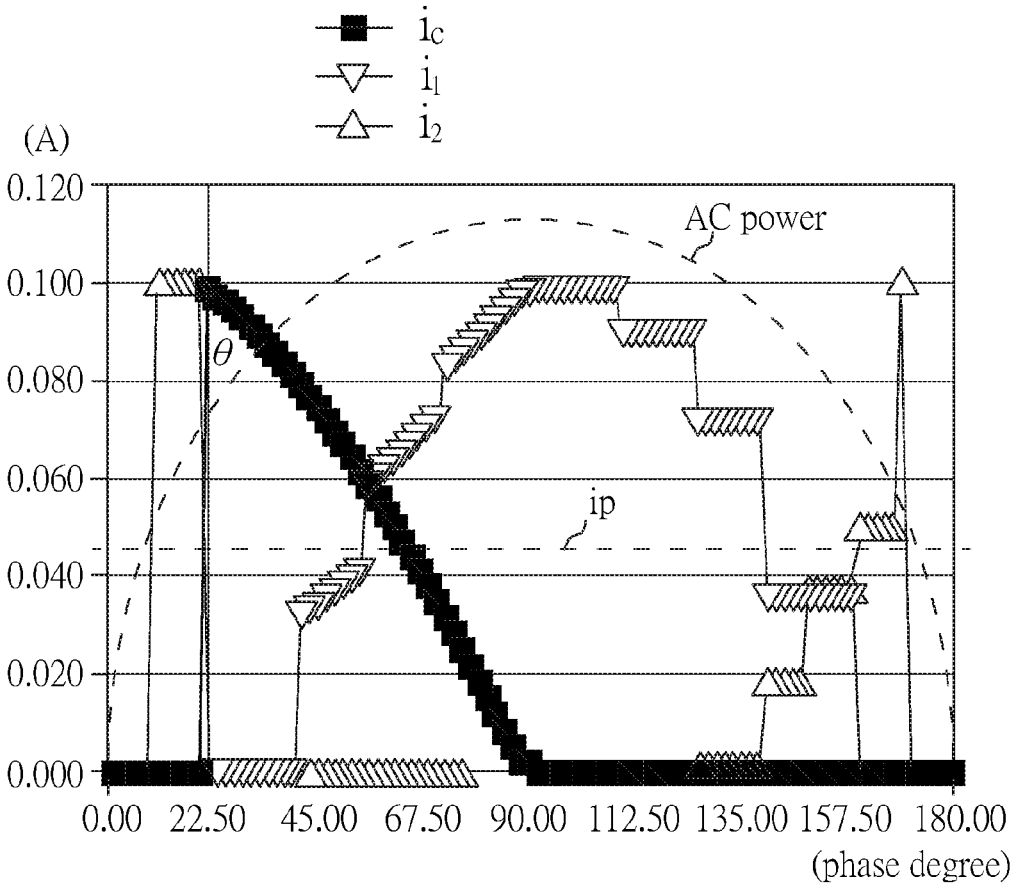
FIG. 3 is a schematic diagram illustrating the waveforms of the capacitor current, the driving current and the compensation current of the LED device in operation.

FIG. 3 is a schematic diagram illustrating the waveforms of the capacitor current (ic), the driving current (i1) and the compensation current (i2) when the LED device 10 is in operation. In this embodiment, the number of the first LED groups L1 to Lm of the first LED driving circuit 20 is four, and the number of the second LED groups E1 to En of the second LED driving circuit 30 is four, which are specified herein for illustrative purpose only. With reference to FIGS. 2(A) to 3, in the increasing period (the phase of 0 to 90 degrees), the energy outputted from the power source 50 is increased from low to high, the capacitor current (ic) flows through the capacitor 40 to charge the capacitor 40, the driving current (i1) is provided to the first LED groups L1 to L4 under the control of the LED driver 21.

In the beginning of the increasing period, for example at the phase of about 22.5 degrees, the capacitor current (ic) has a very high value, the magnitude of the driving current (i1) is low, thus the first LED groups L1 to L4 are off. When the AC power from the AC source 50 gradually reaches to its peak at the phase of 90 degrees, the capacitor current (ic) is gradually decreased, the driving current (i1) is gradually increased, and the first LED groups L1 to L4 are sequentially driven by the first LED driver 21. For example, at the phase of about 45 degrees, as the capacitor current (ic) drops, the LED driver 21 turns on the driving current (i1) flowing through the 1st first LED group L1 to maintain the total consumed current being equal to a first threshold, and the 1st groups L1 is turned on for illumination. At the phase of about 60 degrees, the driving current (i1) is increased to maintain the total consumed current being equal to a second threshold, and the 1 st and 2nd first LED groups L1 and L2 are on for illumination. Similarly, at the phase of about 70 degrees, the driving current (i1) is increased to maintain the total consumed current being equal to a third threshold, the 1st, 2nd and 3rd first LED groups L1 to L3 are on for illumination. At the phase of about 90 degrees, the capacitor current (ic) is decreased to become zero, and the driving current (i1) is increased to become a maximum value, all first LED groups L1 to L4 are on for illumination.

With reference to FIG. 2(A) to 3 again, in the decreasing period (the phase of 90 to 180 degrees), the energy outputted from the power source 50 is decreased from high to low, and the driving current (i1) is gradually decreased, such that the first LED groups L4 to L1 are sequentially turned off so as to stop illuminating. In the decreasing period, when the driving current (i1) is lower than a predetermined value (ip), which is, for example, an average current value of the driving current (i1), the second LED driving circuit 30 starts to draw energy from the pre-charged capacitor 40, so as to generate a compensation current (i2) to drive the second LED groups E1 to E4, thereby keeping the total consumed current (or total consumed energy) of the LED device 10 to be in a specific range.

As shown in FIG. 3, at the phase of about 90 to 1.10 degrees, the magnitude of the driving current (i1) is still high, the first LED groups L1 to L4 are kept in illumination, and the second LED driving circuit 30 is disabled. At the phase of about 110 degrees, the energy outputted from the power source 50 is decreased and fails to illuminate all first LED groups L1 to L4, so that the 4th first LED group L4 is off and the 1st to 3rd first LED groups L1 to L3 are still on. Besides, due to the magnitude of the driving current (i1) is still higher than the predetermined value (ip), the second LED driving circuit 30 is still disabled. At the phase of about 130 degrees, the energy outputted from the power source 50 is lower and fails to illuminate the 1st to 3rd first LED groups L1 to L3, so that the 3rd first LED group L3 is off and the 1st to 2nd first LED groups L1 to L2 are still on. Due to the magnitude of the driving current (i1) is still higher than the predetermined value (ip) in this moment, the second. LED driving circuit 30 is still disabled. At the phase of about 140 degrees, the energy outputted from the power source 50 is lower and fails to illuminate the 1st to 2nd first LED group L1 to L2, so that the 2nd first LED group L2 is off and the 1st first LED group L1 are still on. In this moment, the driving current (a) is lower than the predetermined value (ip), the second LED driving circuit 30 starts to draw energy from the pre-charged capacitor 40 and drive the second LED groups E1 to E4, so as to increase the total illumination. Thus, the flicking of the LED device 10 can be alleviated.

It the embodiment, the compensation current (i2) has a phase inconsistent with that of the power source 50. And a waveform of the total consumed current of the LED device 10 has a phase consistent with that of the power source 50.

Although in this embodiment, the second LED driving circuit 30 is operated in the decreasing period and is still operated in next increasing period until the capacitor is charged by the power source 50, but in other embodiment, the LED driving circuit 30 is operated only in the decreasing period.

Besides, the number of the LEDs of the front LED group E0 can influence the waveform of the capacitor current (ic). For example, if there are more LEDs connected in series with each other in the front LED group E0, the value of the capacitor current (ic) can be higher when it is turned on.

Figure 4A:
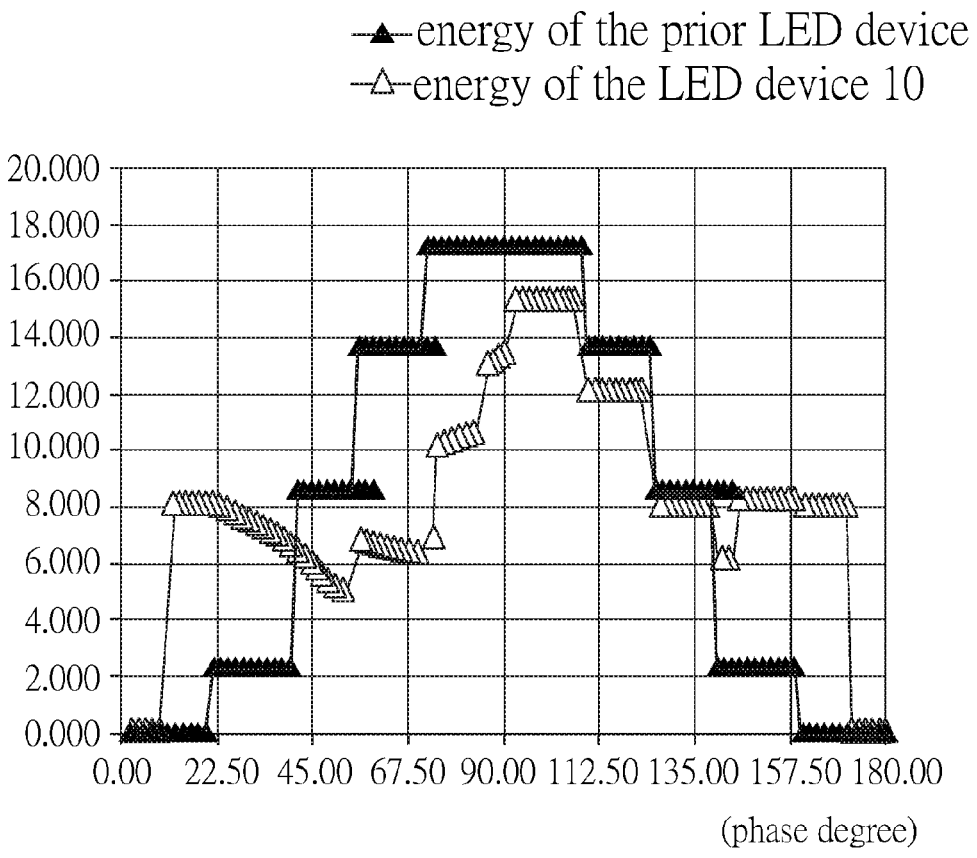
FIG. 4(A) is a schematic diagram illustrating the waveform of the total consumed energy of the LED device according to an embodiment of the invention, in comparison with that of the prior LED device.

FIG. 4(A) is a schematic diagram illustrating the waveform of the total consumed energy of the LED device 10 according to an embodiment of the invention, in comparison with that of the prior LED device. Referring to FIGS. 1 to 4, in the increasing period and the decreasing period, with the capacitor 40 and the second LED driving circuit 30, the variation of the waveform of the total consumed energy in accordance with the present invention is relatively smooth, and thus the flicking problem can be minimized. Besides, the waveform of the total consumed current of the invention is still close to a sinusoid, so as to keep a high PF value.

Figure 4B:
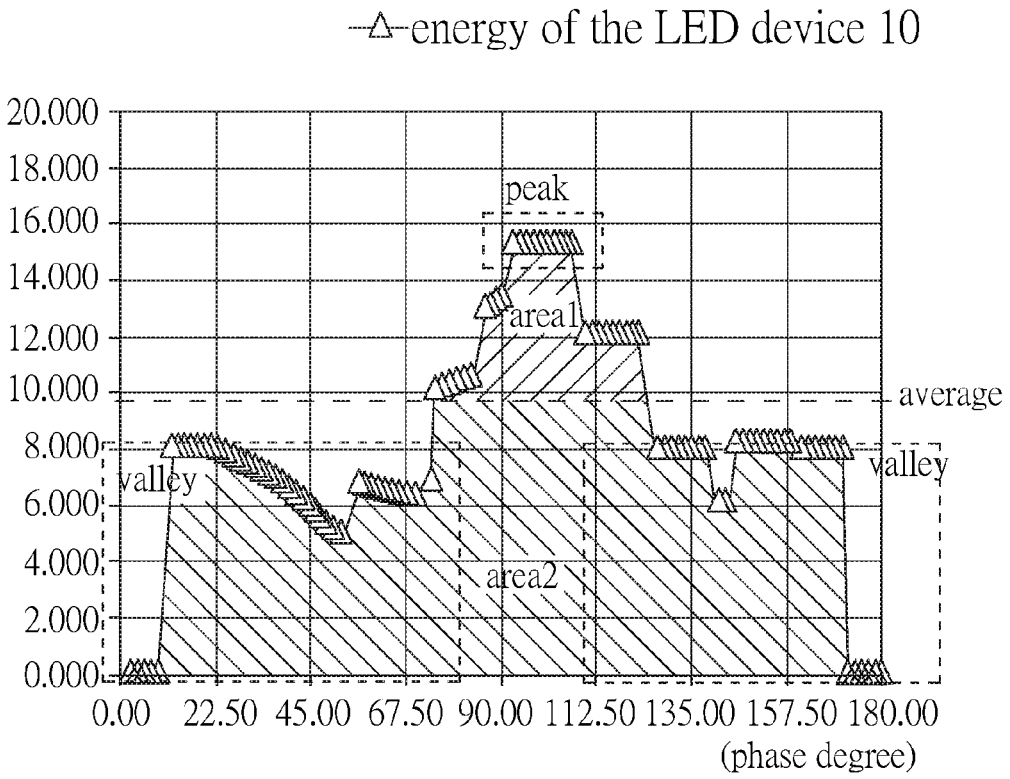
FIG. 4(B) is another schematic diagram illustrating the waveform of the total consumed energy of the LED device according to an embodiment of the invention.

FIG. 4(B) is another schematic diagram illustrating the waveform of the total consumed energy of the LED device 10 according to an embodiment of the invention. Comparing with the prior art in FIG. 1(B), the valley value of the total consumed energy of the LED device 10 in FIG. 4(B) is filled, and the peak value of that is lower and narrow. Due to the valley value is increased and the peak value is decreased, although the average value of the total consumed energy in FIG. 4(B) is close to that in FIG. 1(B), but the area1 is reduced and the area1 is increased in FIG. 4(B), so that the flicking index in FIG. 4(B) is significantly lower than that in FIG. 1(B). Thus, the invention can reduce the flicking problem and keep a high PF value.

Figure 5:
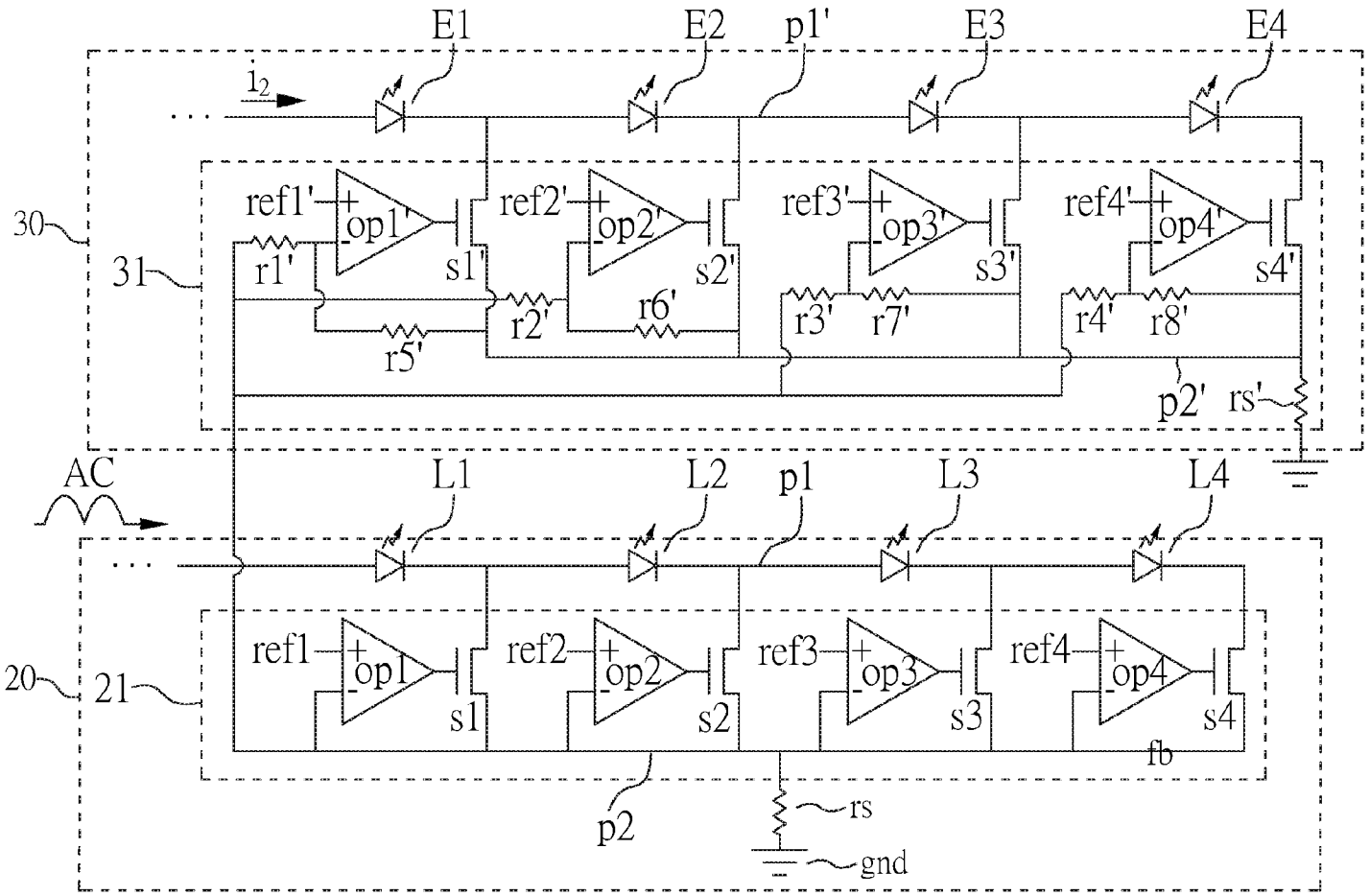
FIG. 5 is a schematic diagram illustrating the detailed structures of the first LED driving circuit and the second LED driving circuit according to an embodiment in the invention.

FIG. 5 is a schematic diagram illustrating detailed circuit structures of the first LED driving circuit 20 and the second LED driving circuit 30 according to an embodiment of the invention. In this embodiment, the number of the first LED groups L1 to Lm is four, and the number of the second LED groups E1 to En is four. It is noted that these circuit structures of the first LED driving circuit 20 and the second. LED driving circuit 30 are specified herein for exemplary purpose. In actual application, each of the LED driving circuit 20 and the second LED driving circuit 30 can be any kind of linear LED driving circuit.

With reference to FIGS. 1(A) to 5, the circuit structure of the first LED driving circuit 20 is similar to the prior linear LED device 100. The first LED driver 21 includes a plurality of first amplifiers op1 to op4 with a number corresponding to that of the first LED groups L1 to L4. Each of the first amplifiers op1 to op4 has a positive input terminal, a negative input terminal and an output terminal. The output terminals of the first amplifiers op1 to op4 are respectively coupled to first switches s1 to s4 for controlling the first LED groups L1 to L4 to be turned on or off to regulate the current to the target values. In this embodiment, the first LED groups L1 to L4 are coupled in series on a first path p1, and one terminal of each of the first switches s1 to s4 is coupled to the first path p1.

In an embodiment, only one of the first amplifiers op1 to op4 can be operated each time, i.e. when the 1st first amplifier op1 is operated, the 2nd to 4th first amplifiers op2 to op4 cannot be operated. Besides, the operation sequence of the first amplifiers op1 to op4 is from the 1st first amplifier op1 to the 4th first amplifier op4. It is said that, in the beginning, the 1st first amplifier op1 is operated, the 2nd to 4th first amplifiers op2 to op4 are not operated, only the 1st first switch s1 is turned on, the driving current (i1) flows through the 1st first LED group L1 and the 1st first switch s1. Then, when the 2nd first amplifier op2 is operated, the 1st first amplifier op1 and the 3rd to 4th first amplifiers op3 to op4 are not operated, only the 2nd first switch s2 is turned on, the driving current (i1) flows through the 1st first LED group L1, the 2nd first LED group L2 and the 2nd first switch s2. Then, when the 3nd first amplifier op3 is operated, the 1st to 2nd first amplifiers op1 to op2 and 4th first amplifiers op4 are not operated, only the 3nd first switch s3 is turned on, the driving current (i1) flows through the 1st first LED group L1, the 2nd first LED group L2, the 3rd first LED group L3 and the 3nd first switch s3. Then, when the 4th first amplifier op4 is operated, the 1st to 3rd first amplifiers op1 to op3 are not operated, only the 4th first switch s4 is turned on, the driving current (i1) flows through the 1st first LED group L1, the 2nd first LED group L2, the 3rd first LED group L3, the 4th first LED group L4 and the 4th first switch s4.

Besides, the first driving energy thresholds ref1 to ref4 corresponding to the first LED groups L1 to L4 are inputted to the positive input terminals of the corresponding first amplifiers opt to op4, respectively. For example, a 1st first driving energy threshold ref1 corresponding to the driving current (i1) only flowing through theist first LED group L1 (which is related to a predetermined value of the driving current (i1) when the 1st first switch s1 is turned on, the 1st first LED group L1 is on, and the 2nd to 4th first LED groups L2 to L4 are off) is inputted to the positive input terminal of the first amplifier op1. Similarly, a 2nd first driving energy threshold ref2 corresponding to the driving current flowing through the 1st and 2nd first LED groups L1 and L2 (which is related to a predetermined value of the driving current (i1) when the 2nd first switch s2 is turned on, the 1st to 2nd first LED groups L1 to L2 are on, and the 3rd to 4th first LED groups L3 to L4 are off) is inputted to the positive input terminal of the first amplifier opt. Similarly, a 3rd first driving energy threshold ref3 corresponding to the driving current (i1) flowing through the 1st to 3rd first LED groups L1 to L3 (which is related to a predetermined value of the driving current (i1) when the 3rd first switch s3 is turned on, the 1st to 3rd first LED groups L1 to L3 are on, and the 4th first LED group L4 is off) is inputted to the positive input terminal of the first amplifier op3. Similarly, a 4th first driving energy threshold ref4 corresponding to the driving current flowing through the 1st to 4th first LED groups L1 to L4 (which is related to a predetermined value of the driving current (i1) when the 4th first switch s4 is turned on, and the 1st to 4th first LED groups L1 to IA are on) is inputted to the positive input terminal of the first amplifier op4. In an embodiment, the negative input terminals of the first amplifiers op1 to op4 are coupled to a second path p2, and the another terminal of each of the first switches s1 to s4 is coupled to the second path p2, while the second path p2 is coupled to ground (gnd) via a sensing resistor (rs).

The second LED driver 31 includes a plurality of second amplifiers op1' to op4' with a number corresponding to that of the second LED groups E1 to E4. Each of the second amplifiers opt' to op4' has a positive input terminal, a negative input terminal and an output terminal. Besides, the output terminals of the second amplifiers op1 to op4' are respectively coupled to second switches s1' to s4' for regulating the second LED groups E1 to E4. In this embodiment, the second LED groups E1 to E4 are coupled in series on a first path p1 and one terminal of each of the second switches s1 to s4' is coupled to the first path p1'.

In an embodiment, only one of the second amplifiers op1' to op4' can be operated each time, i.e. when the 1st second amplifier op1' is operated, the 2nd to 4th second amplifiers op2' to op4' cannot be operated. Besides, the operation sequence of the second amplifiers op1' to op4' is from the 4th second amplifier op4' to the 1st second amplifier op1'. It is said that, when the second LED driver 31 starts to be operated, the 4th second amplifier op4' is operated first, the 3rd to 1st second amplifiers op3' to op1' are not operated, only the 4th second switch s4' is turned on, and the compensation current (i2) flows through the 1st to 4th second LED groups E1 to E4 and the 4th second switch s4'. When the 3rd second amplifier op3' is operated, the 4th second amplifier op4' and the 2nd to 1st second amplifiers op2' to op1' are not operated, only the 3rd second switch s3' is turned on, the compensation current (i2) flows through the 1st second LED group E1, the 2nd second. LED group E2, the 3rd second LED group E3 and the 3rd second switch s3'. And when the 2nd second amplifier op2' is operated, the 4th and 3rd second amplifiers op4' to op3' and the 1st second amplifier op1' are not operated, only the 2nd second switch s2' is turned on, the compensation current (i2) flows through the 1st second LED group E1, the 2nd second LED group E2 and the 2nd second switch s2'. Then, when the 1st second amplifier op1' is operated, the 4th to 2nd second amplifiers op4' to op2' are not operated, only the 1st second switch s1' is turned on, the compensation current (i2) flows through the 1st second LED group E1 and the 1st second switch s1'.

Besides, the second driving energy thresholds ref1' to ref4' corresponding to the second LED groups E1 to E4 are respectively inputted to the positive input terminals of the corresponding second amplifiers op1' to op4'. For example, a 1st second driving energy threshold ref1 corresponding to the compensation current (i2) flowing through only the 1st second LED group E1 (which is related to a predetermined value of the compensation current (i2) when the 1st second switch s1' is turned on, the 1st second LED group E1 is on, and the 2nd to 4th second LED groups E2 to E4 are off) is inputted to the positive input terminal of the second amplifier op1'. Similarly, the 2nd second driving energy threshold ref2' corresponding to the compensation current (i2) flowing through the 1st to 2nd second LED groups E1 to E2 (which is related to a predetermined value of the compensation current (i2) when the 2nd second switch s2' is turned on, the 1st to 2nd second LED groups E1 to E2 are on, and the 3rd to 4th second LED groups E3 to E4 are off) is inputted to the positive input terminal of the second amplifier op2'. Similarly, the 3rd second driving energy threshold ref3' corresponding to the compensation current (i2) flowing through the 1st to 3rd second LED groups E1 to E3 (which is related to a predetermined value of the compensation current (i2) when the 3rd second switch s3' is turned on, the 1st to 3rd second LED groups E1 to E3 are on, and the 4th second LED group E4 is off) is inputted to the positive input terminal of the second amplifier op3'. Similarly, the 4th second driving energy threshold ref4' corresponding to the compensation current (i2) flowing through the 1st to 4th second LED groups E1 to E4 (which is related to a predetermined value of the compensation current (i2) when the 4th second switch s4' is turned on, and the 1st to 4th second LED groups E1 to E4 are on) is inputted to the positive input terminal of the second amplifier op4'. In an embodiment, the negative input terminals of the second amplifiers op1' to op4' are coupled to the second path p2 of the first LED driving circuit 20 via resistors r1' to r4', respectively, and are further coupled to a second path p2' via resistors r5' to r8', respectively, while another terminals of the second switches s1' to s4' are coupled to the second path p2', and the second path p2' is coupled to ground via a sensing resistor rs'.

In an embodiment, the first LED driver 21 and the second LED driver 31 are operated in cooperation with a logic circuit, which is used to determine whether to enable the second amplifiers op1 to op4' (the sequence is from the 4th second amplifier op4' to the 1st second amplifier op1') of the second LED driver 31 to maintain the total consumed energy of the LED device 10 for minimizing the flicking problem.

In an embodiment, the amplifiers op1 to op4' of the second LED driver 31 are operated in a monotonic manner; e.g., the currents (i2) when the all second LED groups E1 to E4 are on to the currents (i2) when only the 1st second LED group E1 is on must be sequentially increased or decreased.

Besides, it is noted that when a number of the first LED groups L1 to Lm is m, the m-th first driving energy threshold refm is related to a predetermined value of the driving current (i1) when the m-th first switch sm is turned on, and the 1st m-th first groups L1 to Lm are on. And when a number of the second LED groups E1 to En is n, the n-th second driving energy threshold refn' is related to a predetermined value of the compensation current (i2) when the n-th second switch sn' is turned on, and the 1st to n-th second LED groups E1 to En are on.

In an embodiment, if a number of the first LED groups L1 to Lm is m, and a number of the second LED groups E1 to En is n, the n-th second driving energy threshold refn' is lower than the m-th first driving energy threshold refm. For example, if m and n both are four, then ref4'<ref4.

In an embodiment, if n both are four, the values of the driving energy thresholds should be monotonic. i.e., the second driving energy thresholds ref1' to ref4' satisfy the relation of ref1'≥ref2'≥ref3'≥ref4' or ref4'≥ref3'≥ref2'≥ref1'.

In another embodiments, the second driving energy thresholds ref1' to ref4' satisfy the regulation of ref1'>ref2'>ref3'>ref4' or ref4'>ref3'>ref2'>ref1'.

Thus, the invention provides an LED device with energy compensation, which makes use of the capacitor 40 and the second LED driving circuit 30 to compensate for both the waveform of the total consumed current and the total consumed energy of the LED device 10, so as to solve the flicking problem and still achieving a high PF value.

Although the present invention has been explained in relation to its preferred embodiments, it is to be understood that many other possible modifications and variations can be made without departing from the spirit and scope of the invention as hereinafter claimed.

What is claimed is:

1. An LED device with energy compensation, comprising:
a first LED driving circuit including a first LED driver and a plurality of first LED groups controlled by the first LED driver, wherein each of the first LED groups includes at least one LED;
a second LED driving circuit including a second LED driver and a plurality of second LED groups controlled by the second LED driver, wherein the second LED driving circuit is connected in parallel with the first LED driving circuit, and each of the second LED groups includes at least one LED; and
a capacitor having a first terminal coupled to the second LED driving circuit,
wherein a power source is coupled to the first LED driving circuit, the second LED driving circuit, and the first terminal of the capacitor for applying an AC power to the first terminal of the capacitor.

2. The LED device with energy compensation of claim 1, wherein the AC power is an voltage with a waveform including an increasing period corresponding to phase of 0 to 90 degrees of the AC power, and a decreasing period corresponding to phase of 90 to 180 degrees of the AC power.

3. The LED device with energy compensation of claim 2, wherein, in the increasing period, the capacitor receives the energy from the power source.

4. The LED device with energy compensation of claim 3, wherein the power source is coupled to the first terminal of the capacitor via a front LED, and a waveform of a capacitor current flowing through the capacitor is influenced by the front LED.

5. The LED device with energy compensation of claim 2, wherein, in the decreasing period, the second LED driver draws energy form the capacitor to enable a compensation current to flow through the second LED groups, and part of a total consumed current of the LED device is increased due to the compensation current.

6. The LED device with energy compensation of claim 5, wherein the compensation current has a phase inconsistent with that of the power source.

7. The LED device with energy compensation of claim 5, wherein a waveform of the total consumed current of the LED device has a phase consistent with that of the power source.

8. The LED device with energy compensation of claim 1, wherein a number of the first LED groups is m, and a number of the second LED groups is n, wherein m and n are positive integer greater than one, and the 1st to m-th first LED groups correspond to 1st to m-th first driving energy thresholds, and the 1st to n-th second LED groups correspond to a 1st to n-th second driving energy thresholds, and the 1st to m-th first driving energy thresholds are monotonic, the 1st to n-th second driving energy thresholds are monotonic.

9. The LED device with energy compensation of claim 8, wherein the n-th second driving energy threshold is lower than the m-th first driving energy threshold.

10. The LED device with energy compensation of claim 1, wherein the first LED driver includes a plurality of first amplifiers with a number corresponding to that of the first LED groups, and the second LED driver includes a plurality of second amplifiers with a number corresponding to that of the second LED groups.

* * * * *